US005514507A

United States Patent [19]

Yagi et al.

[11] Patent Number: 5,514,507

[45] Date of Patent: May 7, 1996

[54] ELECTROPHOTOGRAPHIC PHOTORECEPTOR WITH AMORPHOUS SI-GE LAYER

[75] Inventors: Shigeru Yagi; Tsuyoshi Ohta, both of Minamiashigara, Japan

[73] Assignee: Fuji Xerox Co., Ltd., Tokyo, Japan

[21] Appl. No.: 249,964

[22] Filed: May 27, 1994

[30] Foreign Application Priority Data

May 27, 1993 [JP] Japan ..... 5-146679

[51] Int. Cl.[6] ..... G03G 5/082; G03G 5/14; G03G 5/147

[52] U.S. Cl. ..... 430/57; 430/65; 430/67

[58] Field of Search ..... 430/57, 65, 67

[56] References Cited

U.S. PATENT DOCUMENTS 4,863,820 9/1989 Osawa ..... 430/65 X
4,992,348 2/1991 Hayakawa et al. ..... 430/57

FOREIGN PATENT DOCUMENTS 57-115552 7/1982 Japan .
58-171043 10/1983 Japan .
61-243461 10/1986 Japan .

*Primary Examiner*—Roland Martin
*Attorney, Agent, or Firm*—Oliff & Berridge

[57] ABSTRACT

An electrophotographic photoreceptor for positive electrification comprising at least an electroconductive layer, a charge injection blocking layer, a photoconductive layer and a surface layer. The photoconductive layer comprises a layer having an amorphous silicon layer containing one or more of hydrogen, halogen and a Group III element for controlling electroconductivity and layer having an amorphous silicon germanium layer containing at least hydrogen, halogen and a Group III element. The charge injection blocking layer comprises an amorphous silicon layer containing hydrogen and a Group III element in an amount of equal or less than 1000 ppm. The electrophotographic photoreceptor has excellent electrification characteristics with dark and light sensitivities, stability against repetitive use and may be utilized as a photoreceptor for a semiconductor laser beam printer.

6 Claims, 3 Drawing Sheets

ELECTROPHOTOGRAPHIC PHOTORECEPTOR WITH AMORPHOUS SI-GE LAYER

BACKGROUND OF THE INVENTION

1. Field of the Invention

The present invention relates to an electrophotographic photoreceptor having photosensitivity in the long wavelength range up to about 800 nm which can be applicable as a photoreceptor for a semiconductor laser beam printer and to a method for making the same.

2. Prior Art

Electrophotography is a process comprising charging a photoreceptor, imagewise exposing to provide a latent electrostatic image, developing with a developing agent, then converting it to a toner image and fixing so as to obtain a duplicate. The photoreceptor used in the electrophotography consists basically of a light sensitive layer composed of a photoconductive layer formed on an electroconductive substrate. As the materials forming the photoconductive layer, an inorganic photoconductive material such as selenium or alloys thereof, cadmium sulfide or zinc oxide, or an organic photoconductive material such as polyvinyl carbazole, trinitrofluorenone, bisazo pigments, phthalocyanine, pyrazoline or hydrazone are known. The photoconductive layer may comprise one layer or a plurality of layers laminated.

Photoreceptors using amorphous silicon as a photoconductive layer have recently been developed, and various improvements have been attempted. The photoreceptor using the amorphous silicon consists of a conductive substrate on which is an amorphous silicon film is formed by e.g. glow-discharge decomposition of silane ($SiH_4$), and the hydrogen atoms are trapped in the amorphous silicon film to show the photoconductivity. The amorphous silicon light sensitive material has a high surface hardness of the photoconductive layer layer, a high resistance to scratching, wear and a high temperature, a high mechanical strength, and a high light sensitivity.

However, though the above amorphous silicon photoreceptor has high photosensitivity in the wavelengths range of about 400 to 700 nm, the light absorbability decreases in the longer wavelengths equal or more than 700 nm and the light sensitivity decreases radically.

Modern laser beam printers using semiconductor lasers as light sources require electrophotographic photoreceptors which have high photosensitivity in the longer wavelength range up to 800 nm. The above amorphous silicon photoreceptor however could not satisfy the requirement and thus could not be rendered for practical use for a semiconductor laser printers. Therefore, amorphous silicons containing germanium have been suggested as longer wavelength sensitization methods (Japanese Patent Applications (OPI) No. Sho 57-115552, Sho 58-171043 and Sho 61-243461). In addition, the doping of amorphous silicon germanium photoreceptor with boron was suggested in the 49th Research and Discussion meeting of the Electrophotographical Society (1982).

However, though high sensitivity and high dark resistance are expected as required characteristics of electrophotographic photoreceptor, the photoreceptor sensitized in the long wavelength has low dark resistance and displays special exhausted effects. Such light exhaustion leads to a decrease of the large density and a occurance of ghost image to deteriorate the image quality.

In addition, the charge injection blocking layer formed between the substrate and the photoconductive layer is required to avoid the injection of charges having the opposite polarity to the polarity of the electrification. On the other hand, the charges having the same polarity as the polarity of the electrification are required to flow toward the subtrate at the time of irradiation. Thus it can be imagined that in general a p-type layer for positive electrification and a n-type layer for negative electrification may be formed in an amorphous silicon photoreceptor. However, if a layer in which the polarity has been changed by doping amorphous silicon hydrogenated with a high content of a group III element or a group V element, the adhesive characteristics with the substrate or with the photoconductive layer formed on the substrate become worse. Therefore, a layer containing carbon, nitrogen or oxygen as a third element is formed heretofore.

However, if these third elements are contained, the charge injection blocking capability is insufficient, in particular it tends to be in sufficient in a high electric field, there occurs a problem that the electrification potential is easy to fall due to the repeated electrification in the dark and that the residual potential occurs.

SUMMARY OF THE INVENTION

The object of the present invention is to dissolve the aforementioned disadvantages of the amorphous silicon photoreceptor.

An object of the present invention is thus to provide an electrophotographic photoreceptor having a sensitivity in long wavelength range up to 800 nm and being applicable as a photoreceptor for semiconductor laser beam printer and a method for manufacturing the same.

Another object of the present invention is to provide an electrophotographic photoreceptor having an excellent electrification characteristics or electrification capability in the dark and an excellent light sensitivity and a method for manufacturing the same.

Still another object of the present invention is to provide an electrophotographic photoreceptor having a high heat resistance, a high stability against chemicals, a high mechanical strength such as an abrasion resistance, and an excellent stability against repetitive use.

The present inventors have researched so as to dissolve the aforementioned disadvantages, then have found that an electrophotographic photoreceptor having a photoconductive layer comprising an amorphous silicon layer having a high light sensitivity over the range of the visible light region and an amorphous silicon germanium layer having a high light sensitivity in the long wavelength range up to 800 nm and a charge injection blocking layer comprising an amorphous silicon hydrogenated layer doped only with a predetermined amount of a group III element or only with nitrogen has a low light exhaustion, a low dark decay, an excellent cycle characteristic after pause unexpectedly and that it can attain the aforementioned purposes of the present invention.

At the same time, the inventors have found that an excellent photoconductive property may be obtained by controlling the intensity ratio of the emission bands since the emission of molecules containing germanium have an effect on the characteristics of the photoreceptor when forming the aforementioned amorphous silicon germanium photoconductive layer using germanium fluoride, in particular the relative intensity ratio of emission bands of GeF and $GeF_2$ correlates strongly with electron density and electric energy in plasma, and correlates decisively with localized rank density of the amorphous silicon germanium layer containing hydrogen and fluorine.

The inventors has completed the present invention based on the above mentioned discoveries.

The electrophotographic photoreceptor of the present invention is an electrophotographic photoreceptor for positive electrification comprising at least an electroconductive layer, a charge injection blocking layer, a photoconductive layer and a surface layer, wherein said photoconductive layer comprises a layer having amorphous silicon as a main body containing at least one or more of hydrogen, halogen and group III element controlling electroconductivity and a layer having amorphous silicon germanium as a main body containing at least hydrogen, halogen and said group III element, and said charge injection blocking layer comprises amorphous silicon layer containing only hydrogen and equal or less than 1000 ppm of said group III element.

The electrophotographic photoreceptor of the present invention is an electrophotographic photoreceptor for negative electrification comprising at least an electroconductive layer, a charge injection blocking layer, a photoconductive layer and a surface layer, wherein said charge injection blocking layer comprises amorphous silicon layer containing only hydrogen and nitrogen and having a nitrogen atomic ratio to silicon of 0.01–0.7.

Each of the electrophotographic photoreceptors may preferably have a surface layer comprising one layer or a plurality of layers laminated selected from the group consisting of a layer having amorphous silicon as a main body containing one or more of a group III element, a group V element, carbon, nitrogen and oxegen, a layer having amorphous carbon as a main body containing one or more of the above elements other than carbon and containing equal or less than 50 atomic % of at least one of hydrogen and halogen and a layer having amorphous silicon and amorphous carbon as a main body.

In addition, the method for manufacturing of the present invention comprises forming at least a electrophotoconductive substrate, a charge injection blocking layer, a photoconductive layer and a surface layer, said photoconductive layer comprising a layer having amorphous silicon as a main body containing at least one or more of hydrogen, halogen and a group III element controlling the electroconductivity and a layer having amorphous silicon germanium as a main body containing at least hydrogen, fluorine and a group III element, wherein said layer having amorphous silicon germanium as a main body is formed by plasma discharging in which the intensity of the emission band of $GeF_2$ is higher than that of GeF in the vicinity of 340 nm in a plasma emission.

DETAILED DESCRIPTION OF THE INVENTION

Figure 1:
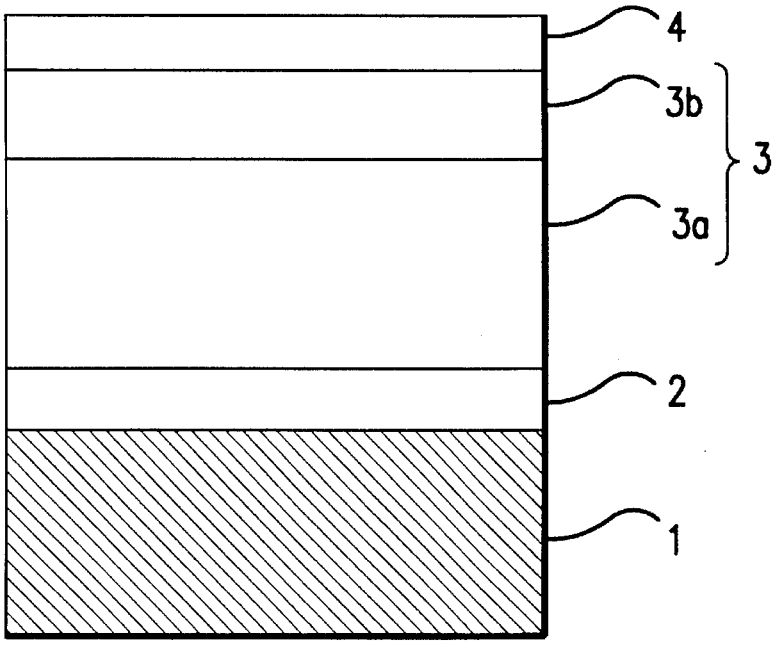
FIG. 1 is a longitudinal sectional view of the electrophotographic photoreceptor of the present invention.

FIGS. 1 to 4 show longitudinal sectional views of the electrophotographic photoreceptors of the present invention. In FIG. 1, a photoreceptor having a charge injection blocking layer 2 comprising amorphous silicon, a photoconductive layer 3 comprising a layer *3a* having amorphous silicon as a main body and a layer *3b* having amorphous silicon germanium as a main body and a surface layer 4 comprising a layer having amorphous silicon or amorphous carbon as a main body, formed in sequence on a electroconductive substrate 1, is shown.

Figure 2:
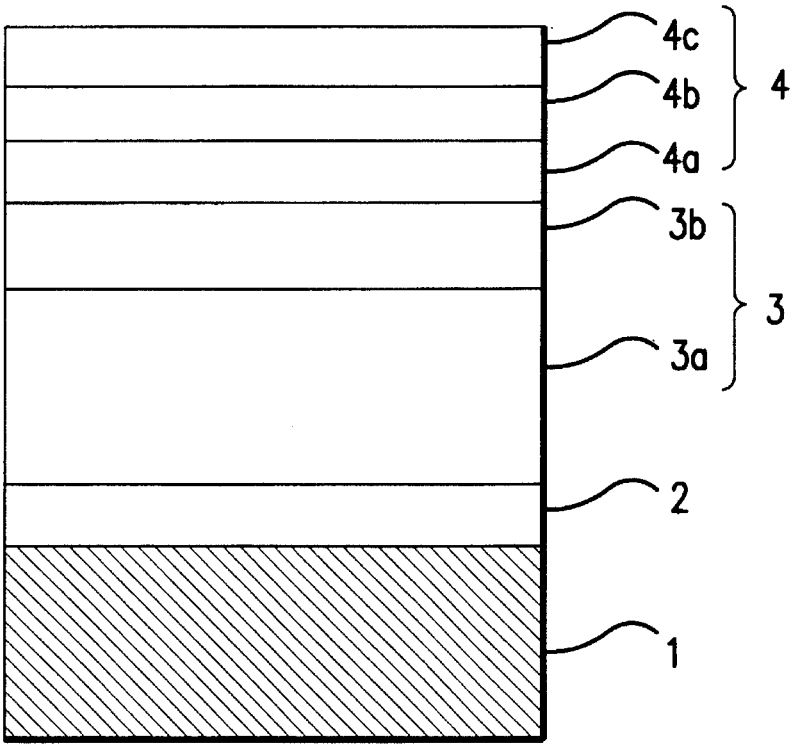
FIG. 2 is another longitudinal sectional view of the another electrophotographic photoreceptor of the present invention.

In FIG. 2. the surface layer 4 is formed of three layers *4a*, *4b* and *4c* comprising the combination of layers having amorphous silicon and/or amorphous carbon as main bodies. In addition, in FIG. 3, the photoconductive layer 3 is formed on the charge injection blocking layer in sequence of the above layers *3a* and *3b* and the surface layer 4 is formed of double-layer structure comprising the layers *4a* and *4b*. In addition. in FIG. 4, the layer *3b* is sandwiched between the layers *3a* in the photoconductive layer 3.

In the present invention, the electroconductive substrate may be made from metals such as aluminum, nickel, chrome and alloys such as stainless steel, plastic sheet having an electroconductive film and paper which has been treated in order to have electroconductivity. Among them, the substrate formed from so called austenire stainless steel, Cr—Ni-containing steel is preferable and the substrate having a electroconductive layer formed containing at least of molybdenum, chlome, manganese, tungsten or titanium as a main component thereon is more preferable. These electroconductive layer may be formed by plating, sputtering or metallizing. In addition, a substrate having an electroconductive layer formed from chlome, titanium, tungsten or molybdenum as a main component on an aluminum substrate or an electroconductive substrate formed from molybdenum, tungsten or titanium.

The electroconductive layer the surface of which has been abraded may be used. Namely, the layer which has been smoothed with verying the roughness of the abrasive from coarse to fine, with buff abrasion, grindstone abrasion or the like. The roughness of the surface is suitably in the range of 2–0.02S of $R_s$, and preferably in the range of 0.5–0.03S. The surface may be a complete specular surface or a cloudy surface having thin stripes. However, the surface is required to be entirely plain and to have no residual convexes in boundary surface of cutting pitch in the lathe cuttings.

The electroconductive substrate may be used in a cylindrical, plane plate, endless belt or a given forms. The film thickness of the electrocoductive substrate is suitably in the range of 0.5–50 mm and peferably in the range of 1–20 mm.

A charge injection blocking layer is formed on the electroconductive layer. In the present invention, the charge injection blocking layer contains a hydrogen, a group III element or a nitrogen and has amorphous silicon layer containing no other element essentially. Whether a group III element or nitrogen is contained in the layer depends on the polarity of the electrification of the photoreceptor. However, if the layer contains a group III element, the photoreceptor may be used for positive electrification and if the layer contains a nitrogen, it may be used for negative electrification.

If the photoreceptor is used for positive electrification, the hydrogen content in the amorphous silicon layer is suitably in the range of 1–50 atomic % and the group III element content is suitably in the range of 0.01–1000 ppm, and preferably is 1–500 ppm. On the other hand, if the photoreceptor is used for negative electrification, the hydrogen content in the amorphous silicon layer is suitably in the range of 1–50 atomic % and the nitrogen content is suitably in the range of 0.01–0.7 and preferably in the range of 0.02–0.6 in the atomic ratio to silicon.

The film thickness of the charge injection blocking layer is suitably in the range of 0.01–10 μm, and preferably in the range of 0.1–10 μm.

The electrophotographic photoreceptor of the present invention in which the charge injection blocking layer does not contain essentially an element other than hydrogen and a group III element or hydrogen and nitrogen has a low light exhaustion, a low dark decay and a cycle characteristics after a pause.

The electrophotographical photoreceptor of the present invention may have a support layer acting as an adhesive layer between the electroconductive substrate and the charge injection blocking layer. The support layer may comprise amorphous silicon containing at least one of carbon, nitrogen and oxygen. The film thickness of the layer is suitably in the range of 0.01–5 μm and preferably in the range of 0.1–4 μm.

In the present invention, the photoconductive layer formed on the charge injection blocking layer comprises a layer containing amorphous silicon as a main body containing at least one of hydrogen, halogen and a group III element (a-Si layer) and a layer containing amorphous silicon germanium as a main body containing at least hydrogen, halogen and a group III element (a-SiGe layer). The a-Si layer has a high light sensitivity over the visible ray region and the a-SiGe layer has a high light sensitivity at longer wavelengths ranging from 750–800 nm. Therefore, the combination of the both layers provides a high light sensitivity from the visible ray to longer wavelength up to 800 nm.

In the case of a photoreceptor used in infrared region in the vicinity of 780 nm, the infrared light enters a photoconductive layer to a depth to generate both carriers of electrons and positive holes since it has a high transmittance. Thus it is required to move the both carriers in the photoconductive layer sufficiently so as to keep the photoreceptor characteristics favorable. If a group III element is not added into the photoconductive layer, electrons move since the amorphous silicon layer and amorphous silicon germanium layer show n-type but positive holes do not move. An addition of an adequate amount of a group III element is effective in order to keep the movement of the positive holes appropriately, thus it contributes to the potential attenuation of the photoreceptor. The suitable amount of doping of a group III element depends upon the amount of defects in the layer. The amount of defects is a-Si<a-SiGe, therefore, the most appropriate amount of doping of the group III element is B(a-Si)≦B(a-SiGe). For example, preferably, the group III element content in said amorphous silicon layer 0.01–500 ppm to silicon, and the group III element content said amorphous silicon germanium layer is 0.1–1000 ppm to silicon and germanium. In particular, in the case of a photoreceptor for negative electrification, the range of 0.1–500 ppm to silicon and the range of 0.5–1000 ppm to silicon and germanium are preferable. In the case of a photoreceptor for positive electrification, the range of 0.01–100 ppm to silicon and the range of 0.1–200 ppm to silicon and germanium are preferable. Thus electrons and positive holes can move between the layers without difficulties and may provide excellent characteristics such as residual potential, stability against repeated operation and sensitivity.

Figure 3:
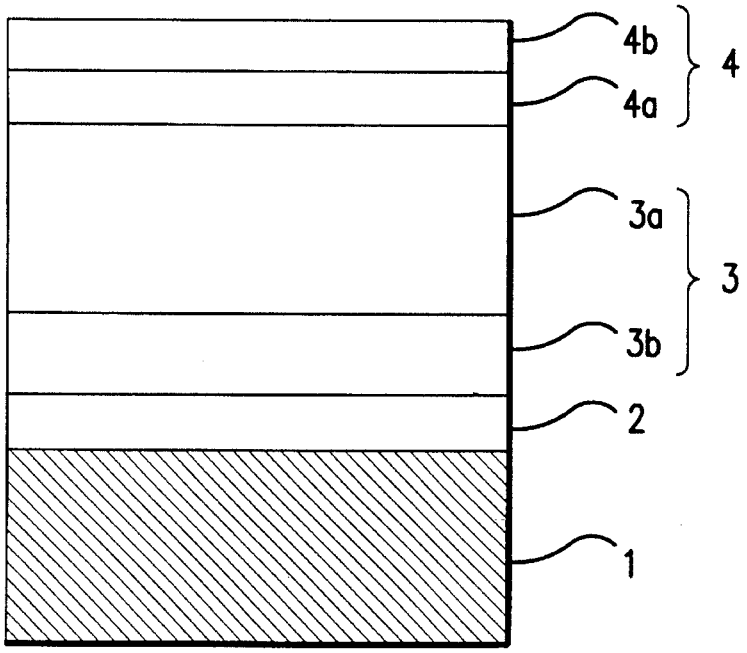
FIG. 3 is still another longitudinal sectional view of the electrophotographic photoreceptor of the present invention.
Figure 4:
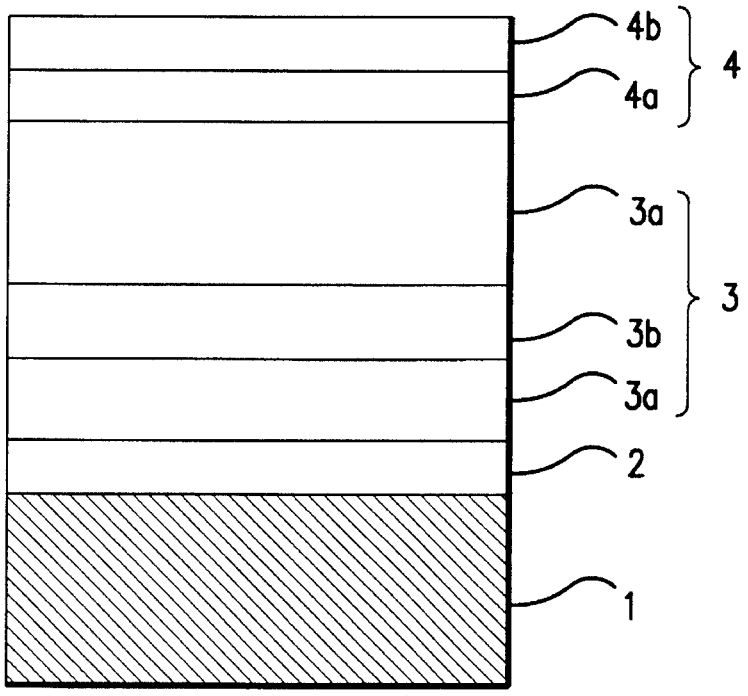
FIG. 4 is still another longitudinal sectional view of the electrophotographic photoreceptor of the present invention.

The laminated structure of the both layers is usually arranged from a-Si layer to a-SiGe layer. However, the a-Si layer and the a-SiGe layer may be laminated reversely as shown in FIGS. 3 and 4 or the a-SiGe layer may be sandwiched between the a-Si layers.

The a-Si layer is preferably formed from amorphous silicon as a main body containing at least one of hydrogen and halogen, and preferably contains a group III element such as boron as an impurity element controlling electroconductivity so as to increase the charge holding property. The film thickness of the a-Si layer is preferably in the range of 1–100 μm.

The hydrogen and/or halogen content is suitably in the range of 3–40 atomic %. The group III element content depends on the polarity of the electrification of the photoreceptor and the required spectral sensitivity, and is suitably in the range of 0.01–1000 ppm. If the photoreceptor is used for positive electrification, the content is in the range of 0.1–1000 ppm and if it is use, for negative electrification, the content is in the range of 0.01–100 ppm. In addition, the a-Si layer may further include carbon, nitrogen and oxygen or the like for the purpose of improvement of electrification characteristics, decrease of dark decay and improvement of sensitivity.

The a-SiGe layer contains at least hydrogen and a halogen and further contains a group III element controlling the conductivity. The germanium atomic ratio to silicon is preferably in the range of 0.1–1. The film thickness of the a-SiGe layer is suitably in the range of 0.1–50 μm, preferably in the range of 0.5–20 μm.

The halogen may include fluorine, chlorine and bromine, fluorine being most preferable. A halogen is added in order to improve the photoconductivity and may be contained in an amount of 1–50 atomic % alone or mixed with another halogen element(s). The group III element may include preferably boron. For example, the boron content to silicon and germanium depends on the amounts of silicon and germanium and the polarity of the photoreceptor, it is suitably in the range of 0.01–100 ppm. In particular, if the photoreceptor is used for positive electrification, it is in the range of 0.1–1000 ppm. If the photoreceptor is for negative electrification, it is in the range of 0.01–100 ppm.

If a group III element is not added to the a-SiGe layer, the dark decay is high, the residual potential occurs and light exhaustion is high, thus the layer is not proper for practical use. In addition, the a-SiGe layer may also contain at least one of carbon, nitrogen and oxygen for the same purpose as the a-Si layer.

In the present invention, the surface layer formed on the photoconductive layer comprise a-Si layer containing at least one of a group III element, a group V element, carbon, nitrogen and oxygen or a layer comprising amorphous carbon as a main body (a-C layer) containing at least one of a group III element, a group V element, nitrogen and oxygen.

If the surface layer contains at least one of a group III element and a group V element, a group III element or a group V element is chosen depending on the polarity of electrification. If the photoreceptor is used for positive electrification, the layer may contain a group V element. If the photoreceptor is for negative electrification, the layer may contain a group III element. The group V element content is in the range of 0.01–1000 ppm and the group III element content is in the range of 5–10000 ppm. These values may be set appropriately depending upon the film thickness. The film thickness of the surface layer is suitably in the range of 0.01–10 μm, and preferably in the range of 0.1–5 μm.

The surface layer may effectively contain at least one of carbon, nitrogen and oxygen. The contents of these elements are: 1 ppm to 99.9 atomic % (amorphous carbon) as for carbon; 1 ppm to 60 atomic % as for nitrogen; and 1 ppm to 60 atomic % as for oxygen.

The surface layer may contain one or more of hydrogen and halogen. Namely, when the surface layer is a-Si layer, hydrogen and/or halogen may be contained in the amorphous silicon in the range of 3–40 atomic %. When the surface layer is a-C layer, hydrogen and/or halogen may be contained in the amorphous carbon in an amount equal or less than 50 atomic %, preferably 5–50 atomic %. In this case, a high amount of hydrogen or a halogen contained in the layer increases a straight—chain —$CH_2$—bond, —C(halogen)$_2$ bond or branched —$CH_3$ bond, and thus decreases the layer hardness. Therefore, the hydrogen and/or halogen content in the layer is required to be equal or less than 50 atomic % as described above.

If an a-C layer is formed in the surface layer, a photoreceptor having an excellent electrification characteristics under a high temperature and a high humidity, an excellent stability of images against repeated operations and an excellent durability due to the hard film formed.

In the present invention, the surface layer may comprise a plurality of layers comprising the above described a-Si layer and/or a-C layer. FIGS. 2–4 show examples of the surface layer comprising a plurality of layers.

For example, as shown in FIG. 2, if a surface layer is formed of three layers comprising a-Si layers, an atomic ratio of elements in each layer and a film thickness of each layer are preferably in the following range: the atomic ratio of carbon, nitrogen or oxygen to silicon is in the range of 0.1–1.0 and the film thickness is in the range of 0.01–0.1 μm in the first surface layer 4*a*; the atomic ratio of carbon, nitrogen or oxygen to silicon is in the range of 0.1–1.0 and the film thickness is in the range of 0.05–1.0 μm in the second surface layer 4*b*; and the content of carbon, nitrogen or oxygen is higher than that in the second surface layer 4*b* and the atomic ratio of them to silicon is 0.5–1.3 and the film thickness is in the range of 0.01–0.1 μm in the third surface layer 4*c*.

A method for manufacturing the above each layer on the electroconductive substrate will be described hereinafter.

Each of the layers formed on the electroconductive substrate may be formed by means of the plasma discharge method, sputtering, ion plating, vacuum evaporation or the like. Among them, the plasma discharge method such as glow discharge decomposition method by a plasma CVD process is most preferable.

In the case, as a raw material gas, a main material gas containing silicon may be used as for the charge injection blocking layer, the photoconductive layer and the support layer which is formed if desired, and a main material gas containing silicon or a main material gas containing a hydrocarbon or a halogen-substituted hydrocarbon may be used as for the surface layer.

With the glow discharge decomposition method as an example, a method of manufacture will be described hereinafter.

As the raw material gas, a mixed gases of the main raw material gas and a raw material containing required additive atoms may be used. If desired, a hydrogen gas or an inert gas such as helium, argon, neon may be mixed with the mixed gases as a carrier gas.

The decomposition by glow discharge may be made on a D.C. or A.C. The film forming conditions are: frequency of 0–5 GHz, Internal reactor pressure of $10^{-5}$–10 Torr (0.001–1333 Pa), discharge power of 10–3000 W, and the substrate temperature of 30–400° C. The film thickness can be set appropriately by adjusting the discharge time.

If a layer of amorphous silicon or a layer having amorphous silicon as a main body, silanes, preferably $SiH_4$ and/or $Si_2H_6$ may be used as a raw material gas containing silicon. As the raw material gas mixed with the main material gas containing silicon, a gas containing hydrogen, halogen, carbon, nitrogen (one of a group V element), oxygen, a group III element, a group V element may be exemplified.

As the raw material gas containing hydrogen, a hydrogen gas is usually used, but if hydrogen is contained in a main raw gas and/or a mixed gases, a halogen gas may not be added depending on the cases.

As the raw material gas containing a halogen, $SiF_4$, $SiCl_4$, $SiHF_3$, $SiHCl_3$, $SiH_2F_2$, $SiH_2Cl_2$ or the like may be used.

As the raw material gas providing carbon, nitrogen and oxygen, a hydrocarbon such as methane, ethane, propan, acetylene and a hydrocarbon halide such as $CF_4$, $C_2F_6$ as a raw material gas containing a carbon; $N_2$ single gas and a nitrogen hydride compound such as $NH_3$, $N_2H_4$, $HN_3$ as a raw material gas containing nitrogen; and $O_2$, $N_2O$, CO, $CO_2$ as a raw material gas containing oxygen may be used.

As the raw material gas containing a group III element, a gas containing B, Al, Ga, In or the like may be used. Diborane $B_2H_6$ may be used typically, and aluminium borohydride $Al(BH_4)_3$ or the like may be used. In addition, as a raw material gas containing a group V element, a gas containing P, As, Sb or the like may be used besides the above gases containing a nitrogen. Phosphine $PH_3$ may be typically used.

The germanium halide which may be used to form the a-SiGe layer containing at least hydrogen, halogen and a group III element may include $GeF_4$, $GeCl_4$, $GeBr_4$, $GeI_4$, $GeF_2$ , $GeCl_2$, $GeBr_2$, $GeI_2$, $GeHF_3$, $GeH_2F_2$, $GeH_3F$, $GeHCl_3$, $GeH_2Cl_2$, $GeH_3Cl$, $GeHBr_3$, $GeH_2Br_2$, $GeH_3Br$, $GeHI_3$, $GeH_2I_2$, $GeH_3I$. Among them, $GeF_4$ and $GeF_2$ are most appropriate for carring out the present invention and can make the amorphous silicon contain germanium and fluorine effectively.

Hydrogen gas or a gas containing the above germanium the halohydrogenated germanium may be used to make the a-SiGe layer contain hydrogen. The mixed gases containing the both gases can be used. A group III element containing gas such as diborane may be mixed so as to make the SiGe layer contain a group III element as described above.

In the method for manufacturing the electrophotographic photoreceptor of the present invention, if an a-SiGe layer is formed by plasma discharging method, the a-SiGe layer is required to be formed under conditions that the intensity of the emission band of $GeF_2$ is higher than that of GeF in the vicinity of 340 nm in the emission spectrum of the plasma. The intensity of the emission band of GeF increases under the discharge conditions of a low pressure and a high power. On the contrary, the intensity of the emission band of $GeF_2$ increases under the discharge conditions of a relatively high pressure and a low power. If the emission of GeF increases in a plasma discharging, the dark decay of the photoreceptor increases and the light sensitivity in infrared region decreases.

Figure 5:
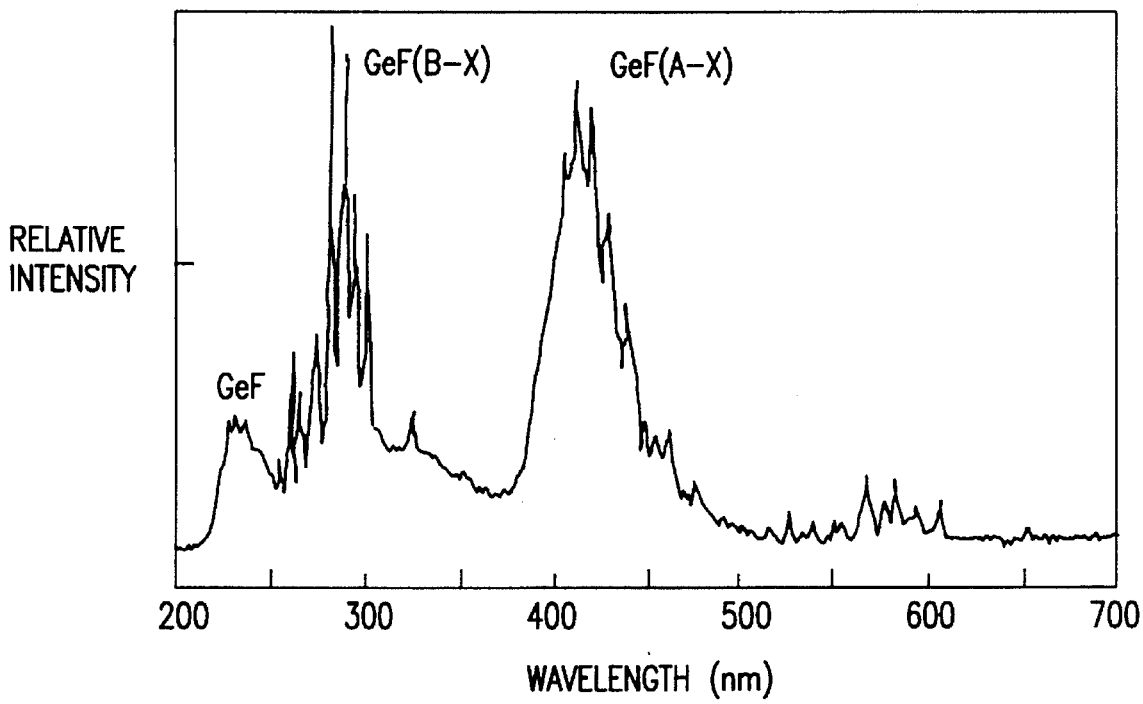
FIG. 5 shows a spectrogram showing the relative emission intensity of GeF in plasma CVD of germanium tetrafluoride.
Figure 6:
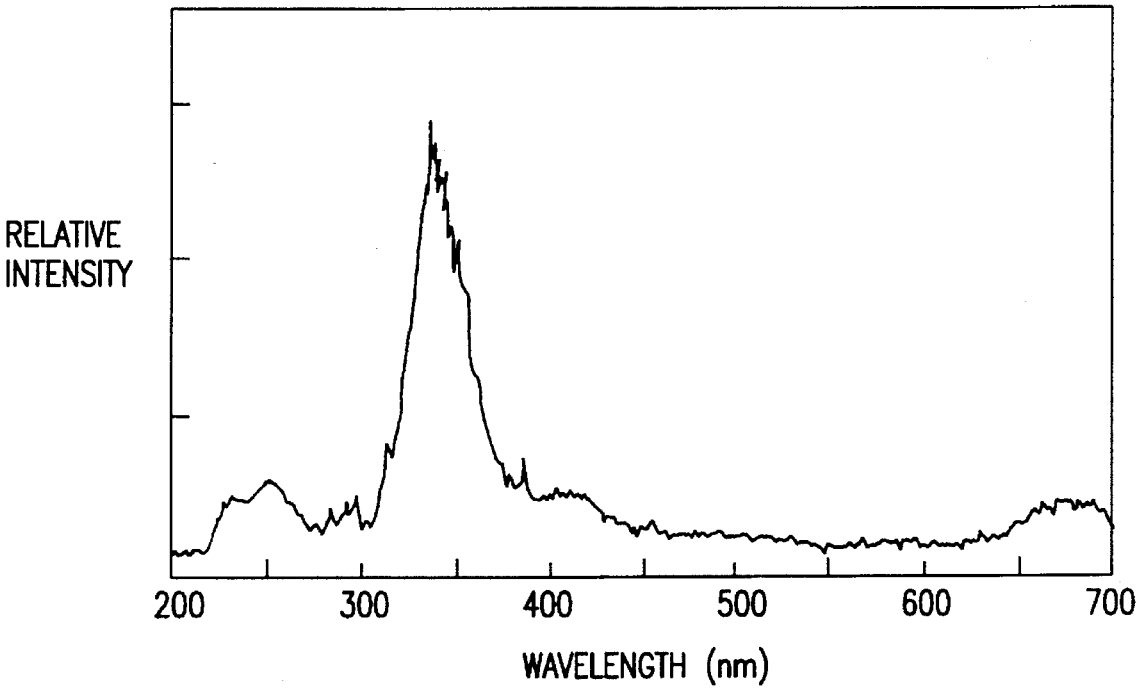
FIG. 6 shows a spectrogram showing the relative emission intensity of $GeF_2$ in plasma CVD of germanium tetrafluoride.

The emission bands of GeF and $GeF_2$ can be distinguished clearly as shown in FIGS. 5 and 6.

As main raw materials forming the a-C layer, the following materials may be used: namely, the raw materials providing a carbon which forms a main body, may include, a straight or branched aliphatic hydrocarbon such as a paraffin hydrocarbon represented by a general formula $C_nH_{2n+2}$ such as methane, ethane, propane, butane and pentane, an olefin hydrocarbon represented by a general formula $C_nH_{2n}$ such as ethylene, propylene, butylene and pentene, and an acetylene hydrocarbon represented by a general formula $C_nH_{2n-2}$ such as acetylene, arylene, butyl; an alicyclic hydrocarbon such as cyclopropane, cyclobutane, cyclopentane, cyclohexane, cycloheptane, cyclobutene, cyclopentene, cyclohexene; an aromatic hydrocarbon such as benzene, toluene, xylene, naphthalene, anthracene; or hydrocarbon-substituted these materials.

When making the a-C layer contain a halogen, hydrocarbon halide such as carbon tetrachloride, chloroform, carbon tetrafluoride, trifluoromethane, chlorotrifluoromethane, dichlorodifluoromethane, bromotrifluoromethane, perfluoroethane, perfluoropropane. In addition, the raw material gas mixed with the main raw material gas containing hydrocarbon or halogen-substituted hydrocarbon may include the above described gases containing nitrogen, oxygen, a group III element, a group V element or the like.

The electrophotographic photoreceptor of the present invention is characterised in that the photoconductive layer comprises an a-Si layer containing at least one of hydrogen, halogen and a group III element controlling electroconductivity and an a-Sige layer containing at least hydrogen, halogen and a group III element and that the charge injection blocking layer, comprises an amorphous silicon hydride layer doped only with equal or less than a specific amount of a group III element or only with nitrogen in a specific range of atomic ratio to silicon. Thus the light sensitivity of the electrophotographic photoreceptor is high in the long wavelength region lip to 800 nm and is sufficiently applicable as a a photoreceptor for semiconductor laser beam printer. The photoreceptor not only has a low light exhaustion and a low dark decay, but also has a favorable cycle characteristics even after pause, though the prior photoreceptor has a problem that the cycle characteristics deteriorate after pause. Furthermore, the photoreceptor has an excellent stability against repeated copying operations.

On the other hand, the method for making the electrophotographic photoreceptor of the present invention comprises forming the above a-SiGe layer under the discharge conditions that the intensity of the emission band of $GeF_2$ is higher than that of GeF in the, vicinity of 340 nm in plasma emission. According to the method for making the photoreceptor, the photoreceptor has a low dark decay and a high light sensitivity in a long wavelength region. In addition, when a germanium fluoride such as $GeF_4$ and $GeF_2$ is used as a raw material, germanium and fluorine may be contained in an amorphous silicon layer effectively.

EMBODIMENT

The present invention will be hereunder described with examples and comparative examples.

EXAMPLE 1

Using a cylindrical aluminum substrate having a thickness of 4 mm as a substrate, an electrophotographic photoreceptor for positive electrification in which a p-type charge injection blocking layer, a photoconductive layer and a surface layer comprising double-layers comprising amorphous silicon nitride and having a film thickness of 0.4 μm were prepared in sequence on the substrate was made as follows:

The inside of the reactor was evacuated thoroughly and by introducing a mixed gases of silane, hydrogen and diborane and decomposing the mixed gases by glow-discharge, a charge injection blocking layer having a film thickness of 2 μm was formed on the sylindrical substrate. The film manufacturing conditions for the above process were as follows:

Flow rate of 100% silane gas: 180 $cm^3$/min

Flow rate of 100% hydrogen Gas: 90 $cm^3$/min

Flow rate of dlborane gas diluted with 200 ppm hydrogen: 90 $cm^3$/min

Internal pressure of reactor: 133.32 Pa (1.0 Torr)

Discharge power: 200 W

Discharge time: 60 min

Discharge frequency: 13.56 MHz

Substrate temperature: 250° C.

It is to be noted that the discharge frequency and the substrate temperature in the following manufacturing conditions for each layer were fixed to the values listed above.

After the formation of the charge injection blocking layer, the inside of the reactor was evacuated thoroughly, and by introducing the mixed gases of silane, hydrogen and diborane and decomposing the mixed gases by glow-discharge, a first photoconductive layer having a film thickness of 20 μm was formed on the charge injection blocking layer. The film manufacturing conditions for the above process were as follows:

Flow rate of 100% silane 180 $cm^3$/min

Flow rate of 100% hydrogen gas: 162 $cm^3$/min

Flow rate of diborane gas diluted with 20 ppm hydrogen: 18 $cm^3$/min

Internal pressure of reactor: 133.32 Pa(1.0 Torr)

Discharge power: 300 W

Discharge time: 200 min

Successively, by introducing a mixed gases of silane, germanium tetrafluoride, hydrogen and diborane and decomposing the mixed gases by glow-discharge, a second photoconductive layer having a film thickness of 2.0 μm was formed on the first photoconductive layer. The film manufacturing conditions for the above process were as follows:

Flow rate of 100% silane gas: 160 $cm^3$/min

Flow rate of 100% germanium tetrafluoride gas: 20 $cm^3$/min

Flow rate of 100% hydrogen gas: 160 $cm^3$/min

Flow rate of diborane gas diluted with 20 ppm hydrogen: 20 $cm^3$/min

Internal pressure of reactor: 133.32 Pa(1.0 Torr)

Discharge power: 300 W

Discharge time: 30 min

In a plasma emission spectrum at the time of film forming, the emission intensity of $GeF_2$ was five times as much as that of GeF in the vicinity of 340 nm.

After the formation of the photoconductive layer, the inside of the reactor was evacuated thoroughly, and by introducing a mixed gases of silane, hydrogen and ammonia and decomposing the mixed gases by glow-discharge, a first surface layer having a film thickness of 0.15 μm was formed on the photoconductive layer. The final manufacturing conditions for the above process were as follows:

Flow rate of 100% silane gas: 20 $cm^3$/min

Flow rate of 100% hydrogen gas: 180 $cm^3$/min

Flow rate of 100% ammonia gas: 30 $cm^3$/min

Internal pressure of reactor: 66.66 Pa(0.5 Torr)

Discharge power: 50 W

Discharge time: 30 min

After the formation of the first surface layer, the inside of the reactor was evacuated thoroughly, and by introducing a mixed gases of silane, hydrogen and ammonia and decomposing the mixed gases by glow-discharge, a second surface layer having a film thickness of 0.25 μm was formed on the first surface layer. The film manufacturing conditions for the above process were as follows:

Flow rate of 100% silane gas: 24 $cm^3$/min

Flow rate of 100% hydrogen gas: 180 $cm^3$/min

Flow rate of 100% ammonia gas: 36 $cm^3$/min

Internal pressure of reactor: 66.66 Pa(0.5 Torr)

Discharge power: 50 W

Discharge time: 40 min

The sensitivity of the light-exposure for half attenuation (the reciprocal of the light-exposure amount for half attenuation) of the photoreceptor thus formed was $0.2\times10^7 cm^2/J$ ($0.2 cm^2/erg$) for light of 780 nm, and the residual potential was 20 V. When repeating each process of electrification, explores and erase was repeated, various electrical characteristics were not changed and the process could be carried out stably.

The boron content in the amorphous silicon germanium layer was 2.2 ppm to silicon and germanium. The boron content in the amorphous silicon layer was 2 ppm to silicon. The photoconductor is appropriate for positive electrification.

The electrophotographic photoreceptor was set on a laser beam printer for positive electrification (XP-9; manufactured by Fuji Xerox Co., Ltd.) and an image quality evaluation test was carried out. An image excellent in resolution and having an even image density was obtained. The dark decay was not changed compared with a photoreceptor having no a-SiGe photoconductive layer. In addition, the cycle characteristics were favorable after leaving if for one week.

EXAMPLE 2

An electrophotographic photoreceptor in which a n-type charge injection blocking layer, a photoconductive layer and surface layer comprising amorphous silicon carbide were formed in sequence on the same substrate as described in Example 1 were formed as follow:

The inside of the reactor was evacuated thoroughly, and by introducing a mixed gas of silane, hydrogen and ammonia and decomposing the mixed gases by glow-discharge, a charge injection blocking layer having a film thickness of 1.0 μm was formed on the substrate. The film manufacturing conditions for the above process were as follows:

Flow rate of 100% silane gas: 20 $cm^3$/min

Flow rate of 100% hydrogen gas: 180$cm^3$/min

Flow rate of 100% ammonia as: 20 $cm^3$/min

Internal pressure of reactor: 66.66 Pa(0.5 Torr)

Discharge power: 100 W

Discharge time: 30 min

The atomic ratio of nitrogen to silicon in the amorphous silicon formed was 0.6.

After the formation of of the charge injection blocking layer, the internal of the reactor was evacuated thoroughly, and by introducing a mixed gases of silane, hydrogen and diborane and decomposing the mixed gases by glow-discharge, a first photoconductive layer having a film thickness of 20 μm was formed on the charge injection blocking layer. The film manufacturing conditions for the above process were as follows:

Flow rate of 100% silane gas: 180 $cm^3$/min

Flow rate of 100% hydrogen gas: 178 $cm^3$/min

Flow rate of diborane gas diluted with 20 ppm hydrogen: 2 $cm^3$/min

Internal pressure of reactor: 133.32 Pa(1.0 Torr)

Discharge power: 300 W

Discharge time: 200 min

Successively, by introducing a mixed gases of silane, germanium tetrafluoride, hydrogen and diborane and decomposing the mixed gases by glow-discharge, a second photoconductive layer having a film thickness of 2.0 μm was formed on the first photoconductive layer. The film manufacturing conditions for the above process were as follows:

Flow rate of 100% silane gas: 150 $cm^3$/min

Flow rate of 100% germaniun tetrafluoride gas: 30 $cm^3$/min

Flow rate of 100% hydrogen gas: 178 $cm^3$/min

Flow rate of diborane gas diluted with 20 ppm hydrogen: 2 $cm^3$/min

Internal pressure of reactor: 133.32 Pa(1.0 Torr)

Discharge power: 300 W

Discharge time: 30 min

In plasma emission spectrum at the time of film forming, the emission intensity of $GeF_2$ was seven times as much as that of GeF in the vicinity of 340 nm.

After the formation of the photoconductive layer, the internal of the reactor was evacuated thoroughly, and by introducing a mixed gases of silane, ethylene and diborane and discomposing the mixed gases by glow-discharge, a surface layer comprising amorphous silicon carbide having a film thickness of 0.3 μm was formed on the photoconductive layer. The film manufacturing conditions for the above process were as follows:

Flow rate of 100% silane gas: 50 $cm^3$/min

Flow rate of 100% ethylene gas: 50 $cm^3$/min

Flow rate of 100% diborane gas diluted with 200 ppm hydrogen: 150 $cm^3$/min

Internal pressure of reactor: 133.32 Pa(1.0 Torr)

Discharge power: 300 W

Discharge time: 30 min

The boron concentration in the a-SiGe layer to silicon and germanium was 0.2 ppm. The boron concentration in the a-Si layer to silicon was 0.2 ppm. The photoreceptor was appropriate for positive electrification.

The sensitivity of the light-exposure for half attenuation of the photoreceptor thus formed was $0.3\times10^7$ $cm^2/J$($0.3$ $cm^2/erg$) for light of 780 nm at a electrification potential of 500 V. The residual potential was 20 V and the electrification potential and residual potential were stable against repeated operation. The dark decay was not changed and was small and favorable compared with a photoconductor having no a-SiGe photoconductive layer.

The boron content in the amorphous silicon germanium layer was 0.2 ppm to silicon and germanium. The boron-content in the amorphous silicon layer was 2 ppm to silicon. The photoconductor is appropriate for positive electrification.

This electrophotographic photoreceptor was set on a laser beam printer for negative electrification (XP-11; manufactured by Fuji Xerox Co., Ltd.), an image quality evaluation test was carried out. An image excellent in resolution and having even image density was obtained. In addition, the cycle characteristics after leaving if for one week was favorable.

EXAMPLE 3

An electrophotographic photoreceptor was made under the same conditions as described in Example 2 except that amorphous carbon layer was formed as a second surface layer on the surface layer formed in Example 2. The film manufacturing conditions for the above process were as follows:

Flow rate of 100% silane gas: 100 $cm^3$/min

Internal pressure of reactor: 40.00 Pa(0.3 Torr)

Discharge power: 800 W

Discharge time: 30 min

Flow rate of 100% ethylene gas: 100 $cm^3$/min

Internal pressure of reactor: 40.00 Pa(0.3 Torr)

Discharge power: 800 W

Discharge time: 30 min

The boron content in the amorphous silicon germanium layer was 0.2 ppm to silicon and germanium. The boron content in the amorphous silicon layer was 0.2 ppm to silicon. The photoreceptor is appropriate for positive electrification.

The repetitive electrification potential of the electrophotographic photoreceptor was determined at a high temperature and a high humidity (30° C., RH85%). Even after ten thousand times, the same potential as the initial value could be obtained.

In addition, an image quality evaluation test of ten thousand copies was carried out using a laser beam printer for negative electrification at a high temperature and a high humidity. An favorable image could be obtained and there were observed no image defect even after carrying out five hundred thousand copying.

While the present invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising:

a) a substrate, b) a charge injection blocking layer formed on a surface of said substrate, c) a photoconductive layer formed on said charge injection blocking layer, and d) a surface layer formed on said photoconductive layer;

said photoconductive layer comprising the following layers:

(i) an amorphous silicon layer containing at least one of a Group III element, hydrogen and halogen; and (ii) an amorphous silicon-germanium layer containing at least a Group III element, hydrogen and halogen;

said Group III element content in said amorphous silicon layer being lower than said Group III element content in said amorphous silicon-germanium layer.

2. An electrophotographic photoreceptor according to claim 1, wherein said Group III element content in said amorphous silicon layer is in the range of 0.01–500 ppm with respect to silicon, and said Group III element content in said amorphous silicon-germanium layer is in the range of 0.1–1000 ppm with respect to silicon and germanium.

3. An electrophotographic photoreceptor according to claim 1, wherein said Group III element content in said amorphous silicon layer is in the range of 0.1–500 ppm with respect to silicon, and said Group III element content in said amorphous silicon-germanium layer is in the range of 0.5–1000 ppm with respect to silicon and germanium.

4. An electrophotographic photoreceptor according to claim 1, wherein said Group III element content in said amorphous silicon layer is in the range of 0.01–100 ppm with respect to silicon, and said Group III element content in said amorphous silicon-germanium layer is in the range of 0.1–200 ppm with respect to silicon and germanium.

5. An electrophotographic photoreceptor according to claim 1, wherein said charge injection blocking layer is an amorphous silicon layer containing at least one of hydrogen, nitrogen and a Group III element.

6. An electrophotographic photoreceptor according to claim 1, wherein said surface layer comprises one layer or a plurality of laminated layer selected from the group consisting of:

a) an amorphous silicon layer containing at least one element selected from the group consisting of a Group III element, a Group V element, carbon, nitrogen and oxygen;

b) an amorphous carbon layer containing at least one of a Group III element, a Group V element, nitrogen and oxygen, and containing equal to or less than 50 atomic % of at least one of hydrogen and halogen; and c) an amorphous silicon-carbon layer containing at least one of a Group III element, a Group V element, nitrogen and oxygen.

* * * * *